US007918523B2

(12) United States Patent
Zengo et al.

(10) Patent No.: US 7,918,523 B2
(45) Date of Patent: Apr. 5, 2011

(54) IMAGE FORMING APPARATUS, IMAGE FORMING METHOD, AND COMPUTER-READABLE MEDIUM STORING A PROGRAM

(75) Inventors: Takeshi Zengo, Kanagawa (JP); Susumu Kibayashi, Kanagawa (JP); Toru Nishida, Kanagawa (JP); Hiroaki Satoh, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 154 days.

(21) Appl. No.: 12/469,772

(22) Filed: May 21, 2009

(65) Prior Publication Data

US 2010/0165027 A1 Jul. 1, 2010

(30) Foreign Application Priority Data

Dec. 25, 2008 (JP) ..... 2008-330713

(51) Int. Cl.
*B41J 29/38* (2006.01)

(52) U.S. Cl. ..... 347/14; 347/9; 347/103

(58) Field of Classification Search ..... 347/9, 14, 347/103

See application file for complete search history.

(56) References Cited

U.S. PATENT DOCUMENTS

| | | | | |
|---|---|---|---|---|
| 6,170,933 | B1 * | 1/2001 | Nitta et al. | 347/42 |
| 2001/0012042 | A1 | 8/2001 | Suganuma | |
| 2002/0101502 | A1 | 8/2002 | Suganuma | |
| 2004/0263875 | A1 | 12/2004 | Okamoto | |
| 2006/0119695 | A1 | 6/2006 | Kojima | |
| 2006/0214985 | A1 * | 9/2006 | Endo | 347/37 |
| 2007/0263021 | A1 | 11/2007 | Tanaka et al. | |

FOREIGN PATENT DOCUMENTS

| | | |
|---|---|---|
| JP | 06-127746 | 5/1994 |
| JP | 08-234590 | 9/1996 |
| JP | 2000-050662 | 2/2000 |
| JP | 2001-213002 | 8/2001 |
| JP | 2004-017505 | 1/2004 |
| JP | 2006-159895 | 6/2006 |
| JP | 2007-301767 | 11/2007 |
| JP | 2008-114547 | 5/2008 |
| WO | 03/033271 | 4/2003 |

* cited by examiner

*Primary Examiner* — K. Feggins
*Assistant Examiner* — Brian J Goldberg
(74) *Attorney, Agent, or Firm* — Fildes & Outland, P.C.

(57) ABSTRACT

The present invention provides an image forming apparatus including: a rotating body that holds recording medias on a circumferential surface; an image forming section that forms an image; a generating section that generates a pulse and a reference pulse; a measuring section that measures the number of pulses; a computing section that each time when predetermined number of pulses from generation of the reference pulse has been measured, divides a pulse width of a pulse before predetermined number of pulses by a first value to compute a pulse division time; and a controlling section that each time when predetermined number of pulses are measured from generation of the reference pulse, multiplies the pulse division time by a second predetermined value, thereby obtaining a forming start time, and that controls to start image formation when the forming start time has elapsed from the measurement of predetermined number of pulses.

8 Claims, 8 Drawing Sheets

FIG. 6

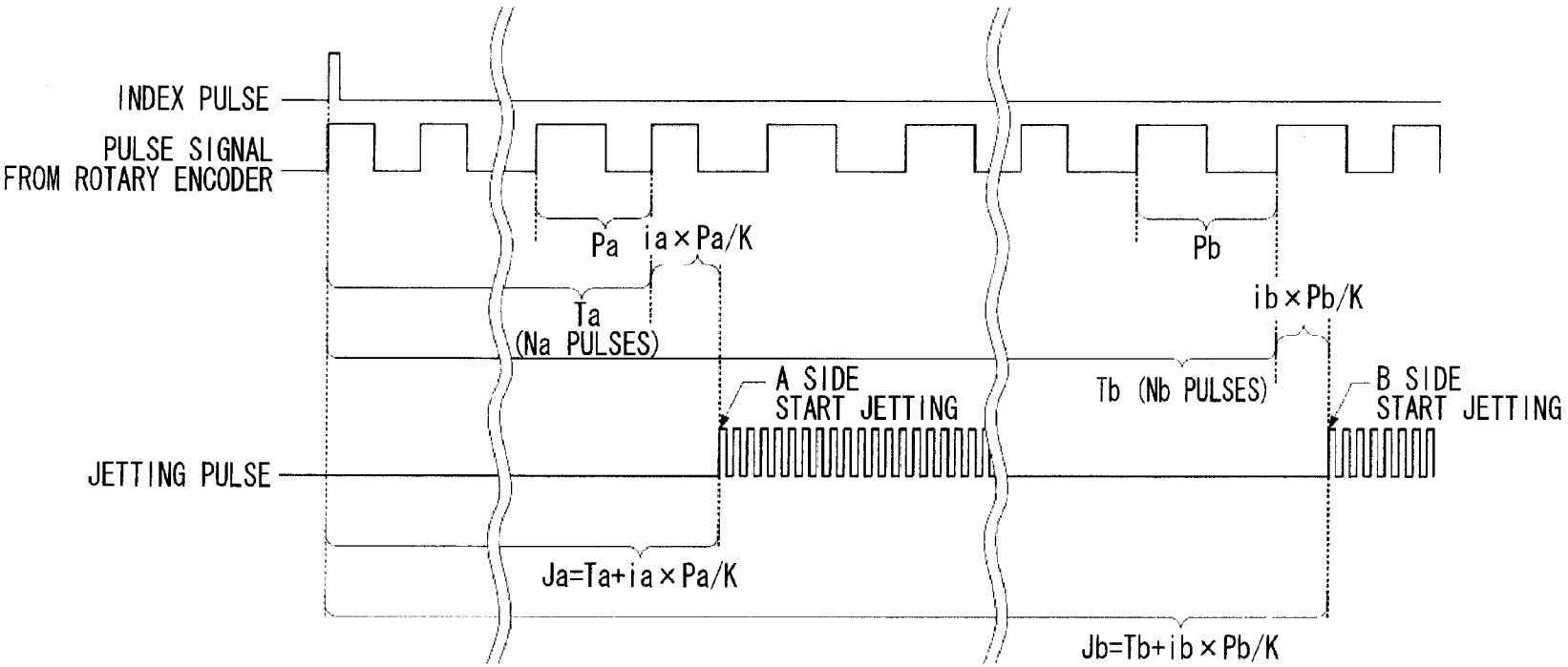

Ja: A SIDE JETTING PULSE START TIME (sec)
Jb: B SIDE JETTING PULSE START TIME (sec)
Na: NUMBER OF ENCODER PULSES COUNTED WITH RISE OF INDEX PULSE AS TRIGGER
Nb: NUMBER OF ENCODER PULSES COUNTED WITH RISE OF INDEX PULSE AS TRIGGER
Ta: TIME DURING WHICH Na PULSES ARE COUNTED (sec)
Tb: TIME DURING WHICH Nb PULSES ARE COUNTED (sec)
Pa: MOST RECENT PULSE TIME WHEN Na PULSES ARE COUNTED (sec)
Pb: MOST RECENT PULSE TIME WHEN Nb PULSES ARE COUNTED (sec)
K: DIVISION NUMBER (–)
ia: NUMBER OF PULSES DIVIDING MOST RECENT PULSE Pa BY K
ib: NUMBER OF PULSES DIVIDING MOST RECENT PULSE Pb BY K

IMAGE FORMING APPARATUS, IMAGE FORMING METHOD, AND COMPUTER-READABLE MEDIUM STORING A PROGRAM

CROSS-REFERENCE TO RELATED APPLICATION

This application is based on and claims priority under 35 USC 119 from Japanese Patent Application No. 2008-330713 filed Dec. 25, 2008.

BACKGROUND

Technical Field

The present invention relates to an image forming apparatus, an image forming method, and a computer-readable medium storing a program.

SUMMARY

According to an aspect of the present invention, there is provided an image forming apparatus including: a rotating body that rotates and holds a plurality of recording media on a circumferential surface of the rotating body; an image forming section that forms an image on the recording media held on the rotating body when rotating; a generating section that generates a pulse signal according to the rotation amount of the rotating body and generates a reference pulse for every rotation cycle of the rotating body; a measuring section that measures the number of pulses of the pulse signal; a computing section that each time when a predetermined number of pulses from the time of generation of the reference pulse has been measured, divides a time of a pulse width of a pulse before the predetermined number of pulses by a first value to compute a pulse division time, the predetermined number of pulses being predetermined for each of the plurality of recording media; and a controlling section that each time when the predetermined number of pulses are measured from the time of generation of the reference pulse, multiplies the pulse division time by a second predetermined value, thereby obtaining a forming start time, and that controls the image forming section so as to start image formation when the forming start time has elapsed from the time of measurement of the predetermined number of pulses, the second predetermined value being predetermined for each of the plurality of recording media.

BRIEF DESCRIPTION OF THE DRAWINGS

Exemplary embodiments of the present invention will be described in detail based on the following figures, wherein:

FIG. 6 is a timing chart for explaining the operation of the image forming apparatus of the exemplary embodiment;

DETAILED DESCRIPTION

Herebelow, an example of an exemplary embodiment of the present invention will be described in detail with reference to the drawings.

Figure 1:
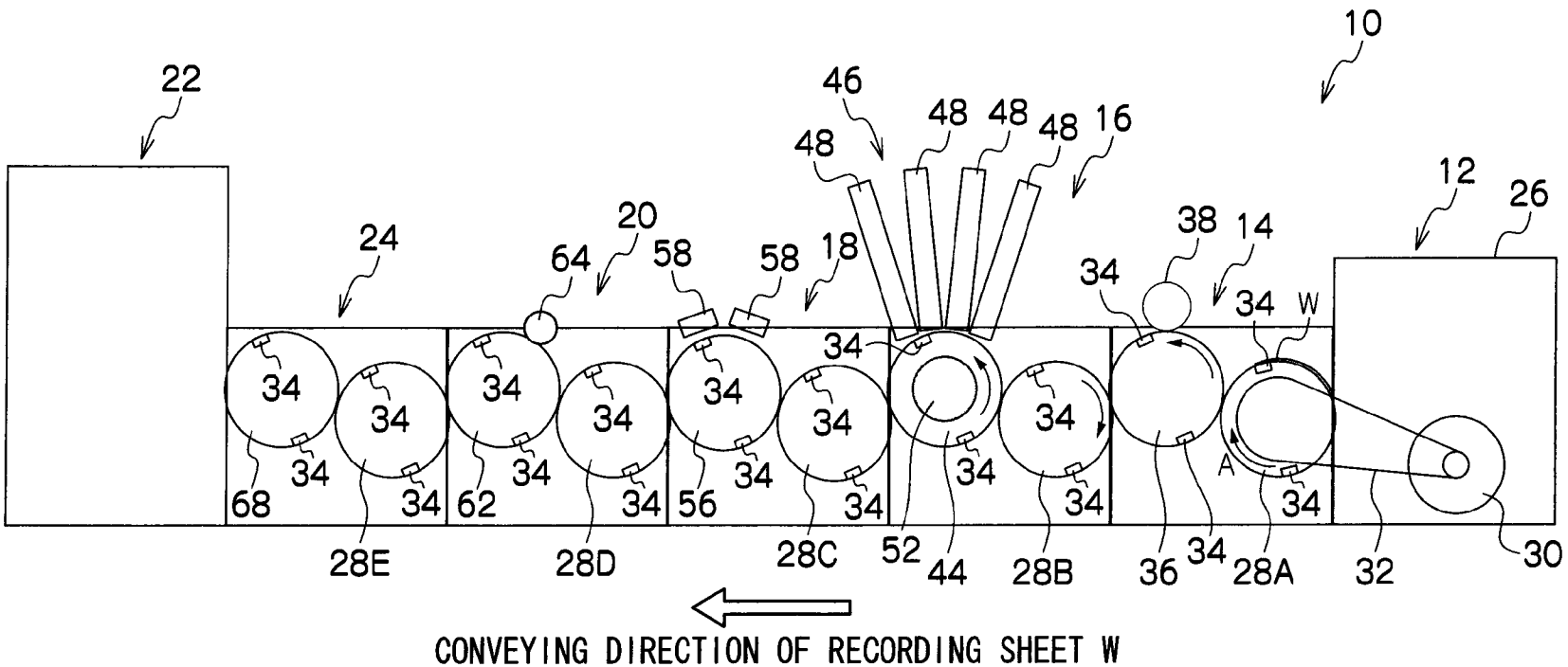
FIG. 1 is a diagram illustrating the configuration of an image forming apparatus according to the exemplary embodiment.

In the exemplary embodiment, the present invention is applied to an image forming apparatus of an ink jet type. FIG. 1 is a diagram illustrating the configuration of an image forming apparatus 10 according to the exemplary embodiment.

As illustrated in FIG. 1, the image forming apparatus 10 has a sheet feeding/conveying section 12 that feeds and conveys a recording sheet W which is a recording medium. A treatment liquid applying section 14, an image forming section 16, an ink drying section 18, an image fixing section 20, and a discharging and conveying section 24 are provided along the conveying direction of the recording sheet W at a downstream side of the sheet feeding/conveying section 12. The treatment liquid applying section 14 applies a treatment liquid onto the recording side (surface) of the recording sheet W. The image forming section 16 forms an image on the recording side of the recording sheet W. The ink drying section 18 dries the image formed on the recording side. The image fixing section 20 fixes the dried image onto the recording sheet W. The discharging/conveying section 24 conveys the image fixed recording sheet W to a discharging section 22.

The sheet feeding/conveying section 12 has a storing section 26 that stores the recording sheet W. The storing section 26 has a motor 30. Further, the storing section 26 has a sheet feeding device (not illustrated). The sheet feeding device conveys the recording sheet W from the storing section 26 to the treatment liquid applying section 14.

The treatment liquid applying section 14 has an intermediate conveying drum 28A and a treatment liquid applying drum 36. The intermediate conveying drum 28A is rotatably disposed between the storing section 26 and the treatment liquid applying drum 36. A belt 32 is extended on the rotational shaft of the intermediate conveying drum 28A and the rotational shaft of the motor 30. Accordingly, the rotational driving force of the motor 30 is transmitted via the belt 32 to the intermediate conveying drum 28A. Due thereto, the intermediate conveying drum 28A is rotated in the arcuate arrow A direction as shown in FIG. 1.

Further, the intermediate conveying drum 28A is provided with sheet grippers 34 which are holding members that grippes the leading section of the recording sheet W, to hold the recording sheet W. The recording sheet W conveyed from the storing section 26 to the treatment liquid applying section 14 is held via the sheet grippers 34 onto the circumferential surface of the intermediate conveying drum 28A. Then, the recording sheet W is conveyed to the treatment liquid applying drum 36 by rotation of the intermediate conveying drum 28A.

As in the intermediate conveying drum 28A, the sheet grippers 34 are provided in later-described intermediate conveying drums 28B, 28C, 28D, and 28E, the treatment liquid applying drum 36, an image forming drum 44, an ink drying drum 56, an image fixing drum 62, and a discharging/conveying drum 68. The recording sheet W is conveyed by the sheet grippers 34 from the upstream drum to the downstream drum.

The treatment liquid applying drum 36 is coupled to the intermediate conveying drum 28A by a gear (not illustrated) and is rotated upon receipt of a rotational force.

The recording sheet W conveyed by the intermediate conveying drum 28A is conveyed to the treatment liquid applying drum 36 via the sheet grippers 34 of the treatment liquid applying drum 36. Then, the recording sheet W held onto the circumferential surface of the treatment liquid applying drum 36 is conveyed.

In the upper section of the treatment liquid applying drum 36, a treatment liquid applying roller 38 is disposed to be contacted with the circumferential surface of the treatment liquid applying drum 36. The treatment liquid applying roller 38 applies a treatment liquid onto the recording side of the recording sheet W on the circumferential surface of the treatment liquid applying drum 36. The treatment liquid reacts with ink to coagulate a coloring material (pigment) to promote separation of the coloring material and a solvent.

The recording sheet W, onto which the treatment liquid is applied by the treatment liquid applying section 14, is conveyed to the image forming section 16 by rotation of the treatment liquid applying drum 36.

The image forming section 16 has the intermediate conveying drum 28B and the image forming drum 44. The intermediate conveying drum 28B is coupled to the intermediate conveying drum 28A by a gear (not illustrated). The intermediate conveying drum 28B is rotated upon receipt of the rotational force of the gear.

The recording sheet W conveyed by the treatment liquid applying drum 36 is conveyed to the intermediate conveying drum 28B via the sheet grippers 34 of the intermediate conveying drum 28B of the image forming section 16. The recording sheet W held onto the circumferential surface of the intermediate conveying drum 28B is then conveyed.

The image forming drum 44 is coupled to the intermediate conveying drum 28A by a gear (not illustrated). Accordingly, the image forming drum 44 rotates upon receipt of the rotational force of the gear.

Figure 2:
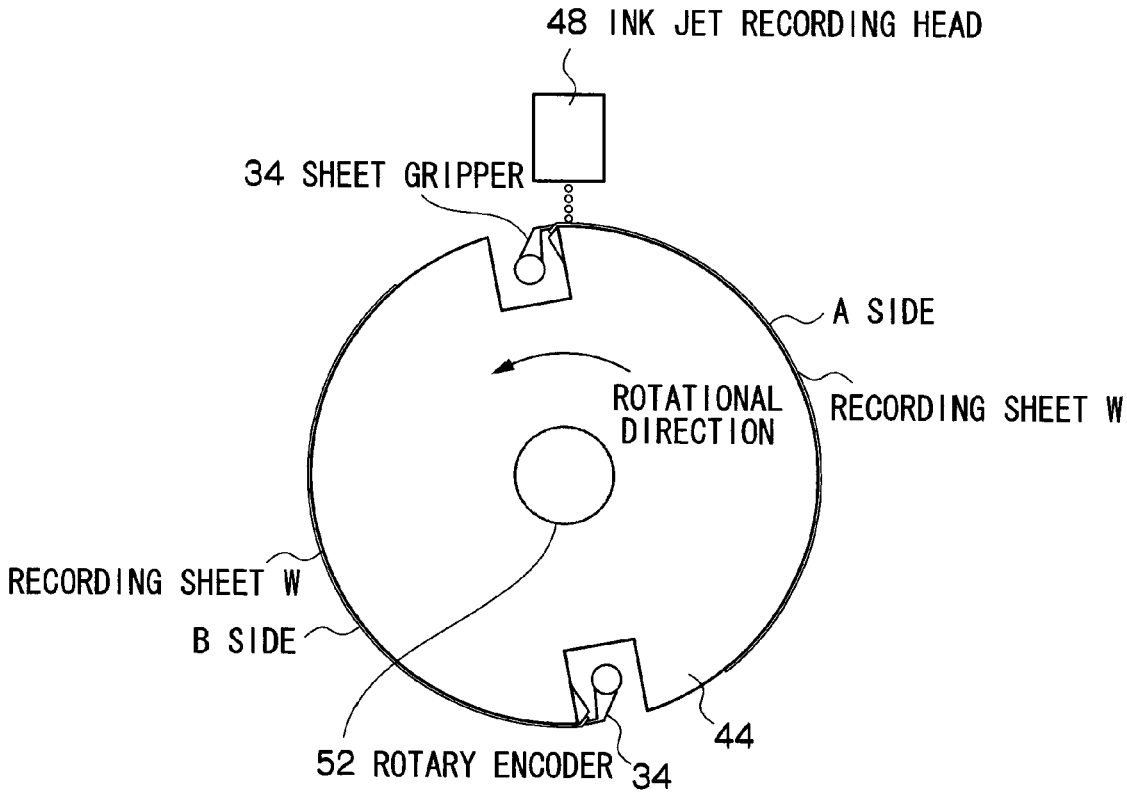
FIG. 2 is a diagram illustrating the structure of an image forming drum of the exemplary embodiment.

As illustrated in FIG. 1, the recording sheet W conveyed by the intermediate conveying drum 28B is conveyed to the image forming drum 44 via the sheet grippers 34 of the image forming drum 44. Then, the recording sheet W held onto the circumferential surface of the image forming drum 44 is conveyed. As illustrated in FIG. 2, the circumferential surface has an A side and a B side. Due thereto, each time the image forming drum 44 is rotated through one revolution, an image is formed by an ink jet recording head 48 (the detail will be described below) on the two recording sheets W held onto the A side and the B side.

A head unit 46 is disposed above the image forming drum 44 so as to be close to the circumferential surface of the image forming drum 44. The head unit 46 has the four ink jet recording heads 48 corresponding to four colors of yellow (Y), magenta (M), cyan (C), and black (K). The recording heads 48 include nozzles (not illustrated) as plural image forming elements forming a dot that configures an image. The recording heads 48 are arrayed along the circumferential direction of the image forming drum 44. The recording head 48 jets an ink droplet from the nozzle on a treatment liquid layer, which is formed on the recording side of the recording sheet W by the treatment liquid applying section 14, thereby forming an image. The image forming drum 44 may hold the plural recording sheets W (in this exemplary embodiment, the two recording sheets W on the A side and the B side) onto the circumferential surface thereof. The image forming drum 44 holding the recording sheets W is rotated so as to form the image on each of the plural recording sheets W by the ink jet recording head 48.

The image forming drum 44 includes a rotary encoder 52. The rotary encoder 52, according to the exemplary embodiment, generates and outputs a pulse signal due to the rotation of the image forming drum 44. One pulse of the pulse signal corresponds to a predetermined rotation angle $\theta_0$ (for instance, 1.257 milli-radians). Further, the rotary encoder 52 according to the exemplary embodiment generates and outputs a reference signal, that is, an index pulse (reference pulse), indicating that the reference point of the image forming drum 44 has been passed by rotation of the image forming drum 44. Namely, the rotary encoder 52 generates the pulse signal according to the predetermined rotation amount (rotation angle) $\theta_0$ of the image forming drum 44, and generates the reference pulse for every rotation cycle of the image forming drum.

The recording sheet W, with the image formed on the recording side by the image forming section 16, is conveyed to the ink drying section 18 by rotation of the image forming drum 44.

The ink drying section 18 includes the intermediate conveying drum 28C and the ink drying drum 56. The intermediate conveying drum 28C is coupled to the intermediate conveying drum 28A by a gear (not illustrated). Accordingly, the intermediate conveying drum 28C rotates upon receipt of the rotational force of the gear.

The recording sheet W conveyed by the image forming drum 44 is conveyed to the intermediate conveying drum 28C via the sheet grippers 34 of the intermediate conveying drum 28C. The recording sheet W, held onto the circumferential surface of the intermediate conveying drum 28C, is then conveyed.

The ink drying drum 56 is coupled to the intermediate conveying drum 28A by a gear (not illustrated). Accordingly, the ink drying drum 56 rotates upon receipt of the rotational force of the gear.

The recording sheet W conveyed by the intermediate conveying drum 28C is conveyed to the ink drying drum 56 via the sheet grippers 34 of the ink drying drum 56. The recording sheet W, held onto the circumferential surface of the ink drying drum 56, is then conveyed.

Above the ink drying drum 56, hot air heaters 58 are disposed close to the circumferential surface of the ink drying drum 56. The unnecessary solvent on the image formed on the recording sheet W is then removed by hot air from the hot air heaters 58. The dried recording sheet W is then conveyed to the image fixing section 20 by rotation of the ink drying drum 56.

The image fixing section 20 includes the intermediate conveying drum 28D and the image fixing drum 62. The intermediate conveying drum 28D is coupled to the intermediate conveying drum 28A by a gear (not illustrated). Accordingly, the intermediate conveying drum 28D rotates upon receipt of the rotational force of the gear.

The recording sheet W conveyed by the ink drying drum 56 is conveyed to the intermediate conveying drum 28D via the sheet grippers 34 of the intermediate conveying drum 28D. The recording sheet W, held onto the circumferential surface of the intermediate conveying drum 28D, is then conveyed.

The image fixing drum 62 is coupled to the intermediate conveying drum 28A by a gear (not illustrated). The image fixing drum 62 rotates upon receipt of the rotational force of the gear.

The recording sheet W conveyed by the intermediate conveying drum 28D is then conveyed to the image fixing drum 62 via the sheet grippers 34 of the image fixing drum 62. The recording sheet W, held onto the circumferential surface of the image fixing drum 62, is then conveyed.

In the upper section of the image fixing drum 62, a fixing roller 64 having a heater therein is disposed to press into contact with the circumferential surface of the image fixing drum 62. The recording sheet W held onto the circumferential surface of the image fixing drum 62 pressed into contact with the fixing roller 64, and is heated by the heater. Accordingly, the coloring material of the image formed on the recording side of the recording sheet W melts onto the recording sheet W to fix the image. The image fixed recording sheet W is then conveyed to the discharging/conveying section 24 by rotation of the image fixing drum 62.

The discharging/conveying section 24 has the intermediate conveying drum 28E and the discharging/conveying drum 68. The intermediate conveying drum 28E is coupled to the intermediate conveying drum 28A by a gear (not illustrated). Accordingly, the intermediate conveying drum 28E rotates upon receipt of the rotational force of the gear.

The recording sheet W conveyed by the image fixing drum 62 is conveyed to the intermediate conveying drum 28E via the sheet grippers 34 of the intermediate conveying drum 28E. The recording sheet W held onto the circumferential surface of the intermediate conveying drum 28E is then conveyed.

The discharging/conveying drum 68 is coupled to the intermediate conveying drum 28A by a gear (not illustrated). Accordingly, the discharging/conveying drum 68 rotates upon reception of the rotational force of the gear.

The recording sheet W conveyed by the intermediate conveying drum 28E is conveyed to the discharging/conveying drum 68 via the sheet grippers 34 of the discharging/conveying drum 68. The recording sheet W, held onto the circumferential surface of the discharging/conveying drum 68, is then conveyed to the discharging section 22.

Figure 3:
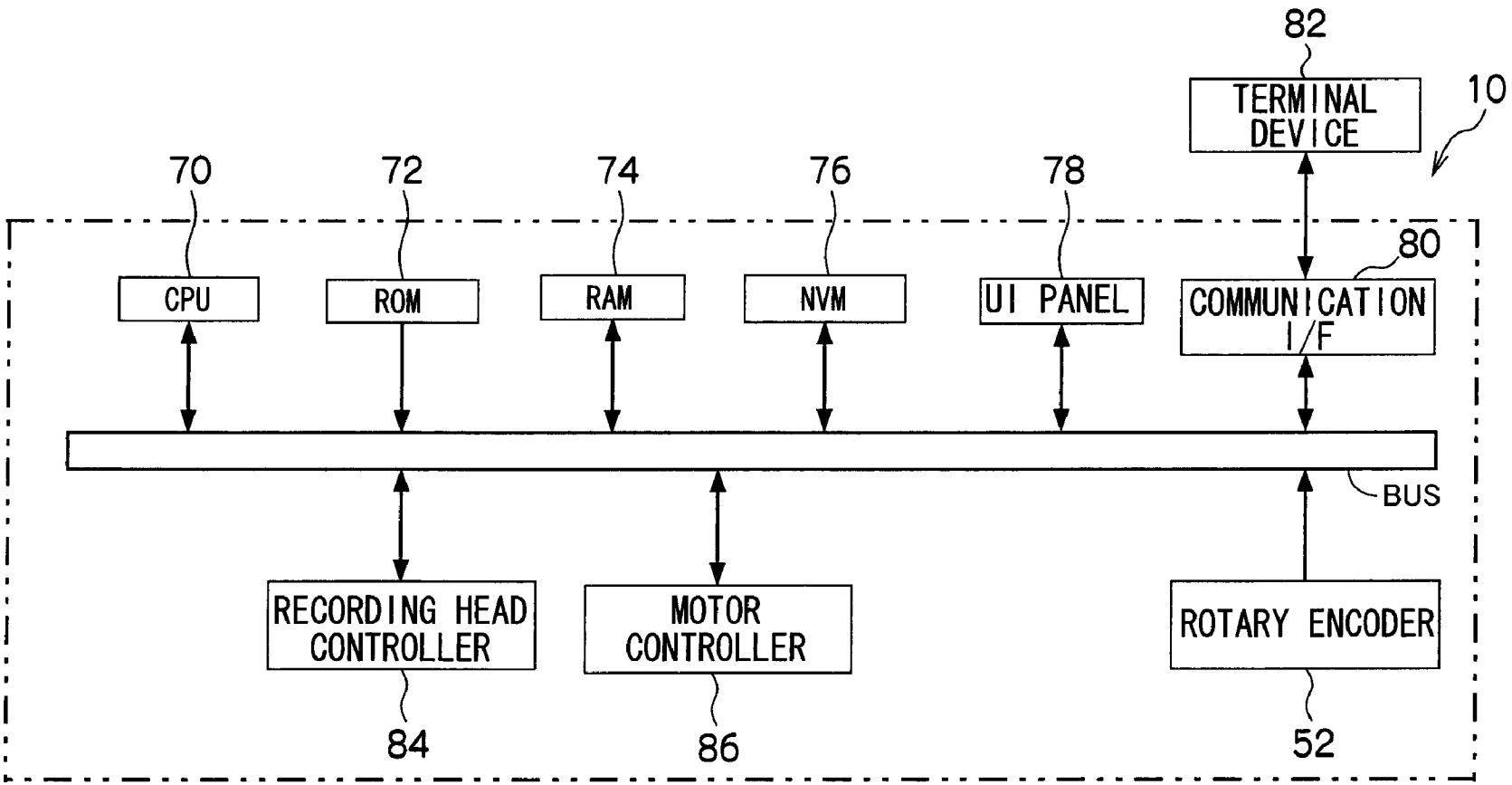
FIG. 3 is a block diagram illustrating the essential configuration of the electric system of the image forming apparatus according to the exemplary embodiment.

FIG. 3 is a block diagram illustrating the essential configuration of the electric system of the image forming apparatus 10 according to the exemplary embodiment.

The image forming apparatus 10 includes a computer (not illustrated). As illustrated in FIG. 3, the computer includes a CPU (Central Processing Unit) 70, a ROM (Read Only Memory) 72, a RAM (Random Access Memory) 74, an NVM (Non Volatile Memory) 76, a UI (User Interface) panel 78, and a communication I/F (Communication Interface) 80.

The CPU 70 controls the operation of the entire image forming apparatus 10. The CPU 70 reads a program from the ROM 72 to execute an image forming control process.

The ROM 72, as a memory section, stores programs for executing the image forming control process that controls the operation of the image forming apparatus 10 (the detail will be described below), and further stores various parameters.

The RAM 74 is used as a work area for executing various programs. The NVM 76 stores various information that needs to be held even when the power switch of the device is turned OFF.

The UI panel 78 includes a touch panel display configured by providing a transmissive touch panel on a display. The UI panel 78 displays various information on the display surface of the display, and inputs desired information and instructions based on the touching of the touch panel by the user.

The communication interface 80 is connected to a terminal device 82 such as a personal computer, or the like. The communication interface 80 receives image information and various information showing an image that is to be formed on the recording sheet W, from the terminal device 82.

The CPU 70, the ROM 72, the RAM 74, the NVM 76, the UI panel 78, and the communication interface 80 are mutually connected via a BUS (system bus). Therefore, the CPU 70 accesses the ROM 72, the RAM 74, and the NVM 76. The CPU 70 displays various information on the UI panel 78 and grasps the contents of an operation instruction of the user to the UI panel 78. The CPU 70 receives various information from the terminal device 82 via the communication interface 80.

Further, the image forming apparatus 10 includes a recording head controller 84 and a motor controller 86.

The recording head controller 84 controls the operation of the ink jet recording head 48 according to an instruction of the CPU 70. The motor controller 86 controls the operation of the motor 30.

Both, the recording head controller 84 and the motor controller 86 are connected to the BUS. The CPU 70 controls the operation of the recording head controller 84 and the motor controller 86.

The rotary encoder 52 is connected to the BUS. The CPU 70 receives the pulse signals generated by the rotary encoder 52. The CPU 70 receives the index pulses generated by the rotary encoder 52.

The operation of the image forming apparatus 10 according to the exemplary embodiment will be described with reference to the drawings.

In the image forming apparatus 10 according to the exemplary embodiment, the recording sheet W is conveyed by the sheet feeding device from the storing section 26 to the intermediate conveying drum 28. The recording sheet W is then conveyed to the image forming drum 44 via the intermediate conveying drum 28, the treatment liquid applying drum 36, and the intermediate conveying drum 28. Then, the recording sheet W is held onto the circumferential surface of the image forming drum 44. According to image information, an ink droplet is jetted from the nozzle of the ink jet recording head 48 onto the recording sheet W on the image forming drum 44. Due thereto, the image shown by the image information is formed on the recording sheet W.

Figure 4:
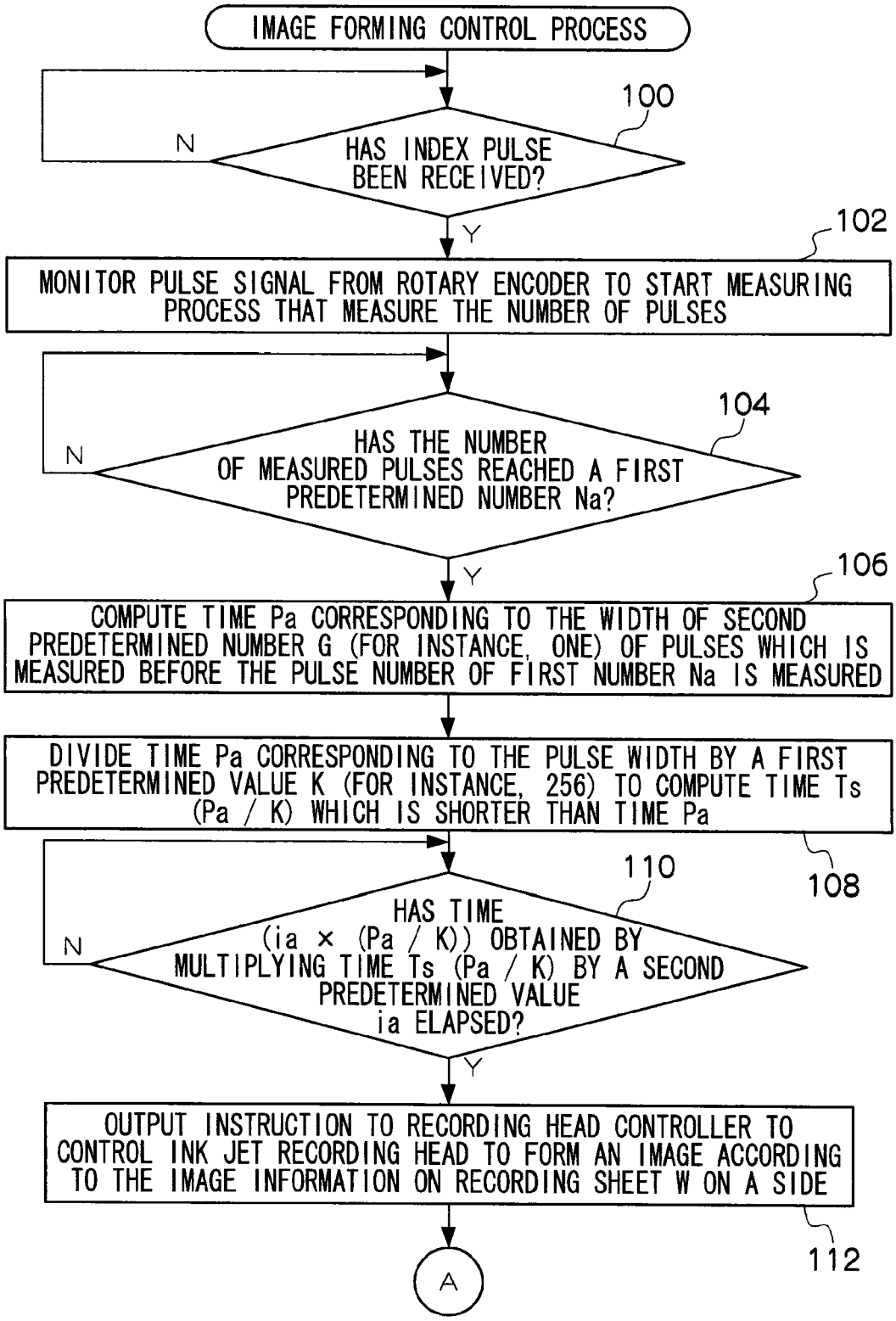
FIG. 4 is a flowchart of an image forming control process executed by a CPU of the image forming apparatus of the exemplary embodiment.
Figure 5:
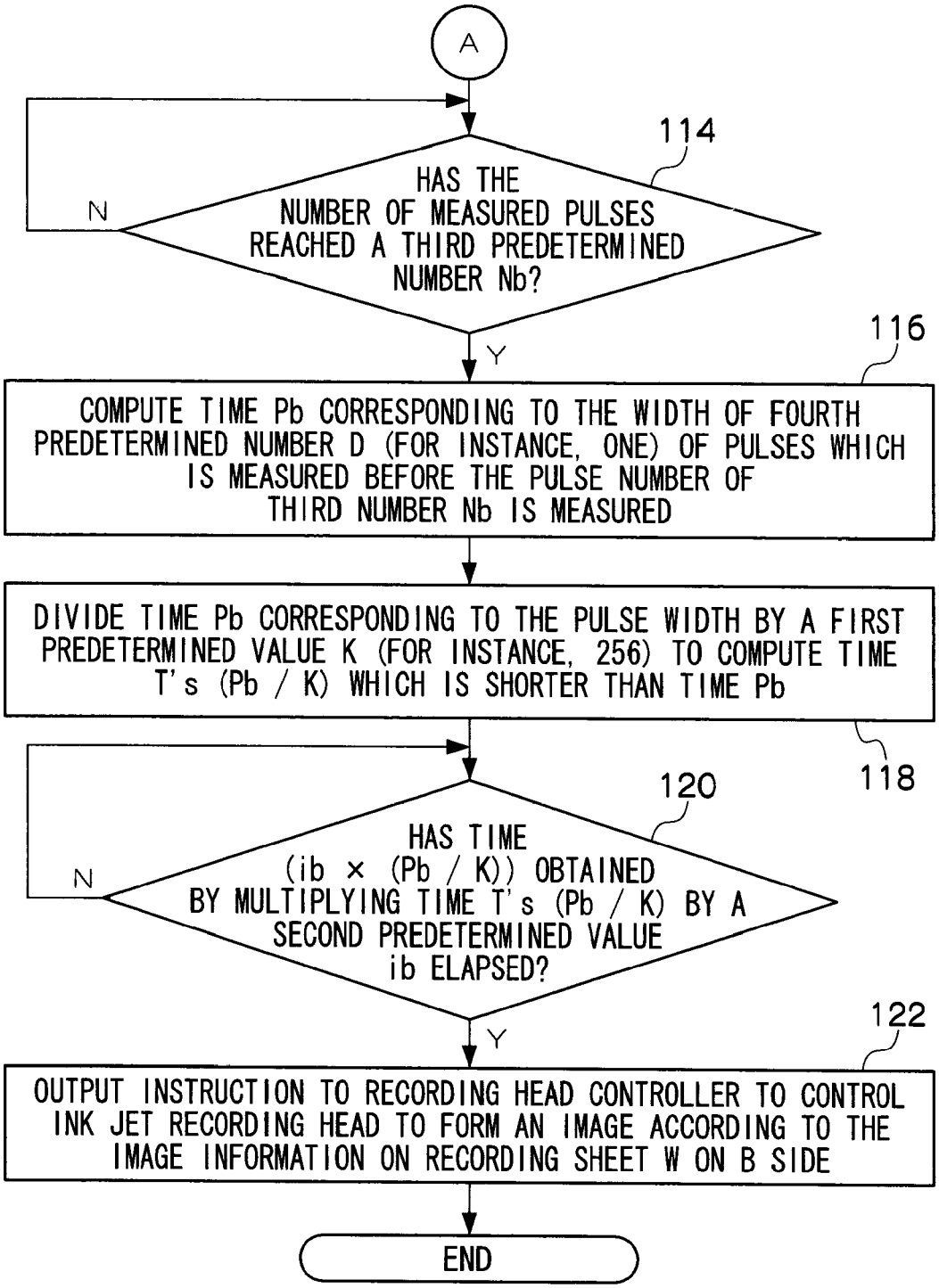
FIG. 5 is a flowchart of the image forming control process executed by the CPU of the image forming apparatus of the exemplary embodiment.

The image forming control process executed by the CPU 70 of the image forming apparatus 10 will be described with reference to FIG. 4 and FIG. 5. In the exemplary embodiment, an instruction for executing an image forming process for forming an image on the recording sheet W, and image information expressing the subject of the image to be formed, are inputted from the terminal device 82 and via the communication I/F 80. When it is determined that the execution instruction and image information have been inputted, the CPU 70 executes the image forming control process.

In step 100, whether the index pulse has been received from the rotary encoder 52 is determined. If it is determined that the index pulse has not been received in step 100, the determination process in step 100 is performed again. On the other hand, if it is determined that the index pulse has been received in step 100, the routine proceeds to step 102. Note that, the timing of reception of the index pulse is the reference timing necessary for performing image formation by the ink jet recording head 48. More specifically, the timing of detection of the rise of the index pulse (the timing of generation of the index pulse) is the reference timing.

In step 102, a measuring process for monitoring the pulse signal from the rotary encoder 52 to measure the number of pulses starts. While the process is performed in steps 102 to 122, the measuring process continues.

In step 104, it is determined whether the number of measured pulses has reached a first predetermined number Na. If it is determined that the number of measured pulses has not reached the first predetermined number Na in step 104, the routine returns to step 104 and performs the determination process again. On the other hand, if it is determined in step 104 that the number of measured pulses has reached the first predetermined number Na, the routine proceeds step 106.

In step 106, a time Pa corresponding to the width (pulse width) of a pulse which is a second predetermined number G of pulses before the first predetermined number Na (for instance, a pulse which is one pulse before the first predetermined number Na), is computed. The value of the second number G is not limited to one, and may be two or more.

In step 108, the time Pa is divided by a first predetermined value K (for instance, 256) to compute a time Ts (=Pa/K) which is shorter than the time Pa that corresponds to the pulse width.

In step 110, after it is determined that the number of pulses measured in step 104 has reached the pulse number of first predetermined number Na, whether a time (ia×(Pa/K)) obtained by multiplying the time Ts (=Pa/K) by a second predetermined value ia corresponding to the A side has elapsed, is determined. If a negative determination is output (if the time (ia×(Pa/K)) has not elapsed), the determination process of step 110 will be performed again. On the other hand, If an affirmative determination is output (if the time (ia×(Pa/K)) has elapsed) the routine proceeds to step 112.

In step 112, in order to form an image according to the image information (by forming a dot corresponding to image information) on the recording sheet W on the A side, an instruction is outputted to the recording head controller 84 so as to control the ink jet recording head 48. Accordingly, the recording head controller 84 controls the ink jet recording head 48 to start image forming, according to the image information, on the recording sheet W on the A side.

The process of steps 100 to 112 will be described with reference to the timing chart of FIG. 6.

As illustrated in FIG. 6, if it is determined in step 100 that the index pulse (reference pulse) has been received, the pulses are measured (counted) until the number of pulses reaches the first number Na of steps 102 and 104. In steps 106 and 108, the time Pa corresponding to the width (pulse width) of a pulse which is a second predetermined number G of pulses before the first predetermined number Na (for instance, a pulse which is one pulse before the first predetermined number Na), is computed. Then, the time Pa is divided by the first predetermined value K (for instance, 256) to compute the Ts (=Pa/K). In steps 110 and 112, after the timing when the pulse number of the first predetermined number Na is measured, when the time (ia×(Pa/K)), which is obtained by multiplying the time Ts (=Pa/K) by the second predetermined value ia that corresponds to the A side, has elapsed, the recording head 48 as the image forming section is controlled to start image forming on the recording sheet W on the A side.

Here, the image forming control process will be described with reference to FIG. 5. In step 114, it is determined whether the number of measured pulses has reached a third predetermined number Nb. In step 114, if it is determined that the number of measured pulses has not reached the third predetermined number Nb, the routine returns to step 114 and performs the determination process again. On the other hand, if it is determined that the number of measured pulses has reached the third predetermined number Nb in step 114, the routine proceeds to step 116.

In step 116, a time Pb corresponding to the width of a pulse which is a fourth predetermined number D of pulses before the third predetermined number Nb (for instance, a pulse which is one pulse before the third predetermined number Nb), is computed. The value of the fourth number D is not limited to one, and may be plural of two or more.

In step 118, the Pb relative to the pulse width is divided by the first predetermined value K (for instance, 256) to compute a time T's (=Pb/K) which is shorter than the time Pb that corresponds to the pulse width.

In step 120, after it is determined that the number of pulses measured in step 114 has reached the pulse number of the third predetermined number Nb, whether a time (ib×(Pb/K)) obtained by multiplying the time T's (=Pb/K) by a second predetermined value ib corresponding to the B side has elapsed, is determined. If a negative determination is output (if the time (ib×(Pb/K)) has not elapsed), the determination process of step 120 is performed again. If an affirmative determination is output (if the time (ib×(Pb/K)) has elapsed), the routine proceeds to step 122.

In step 122, an instruction is outputted to the recording head controller 84 to control the ink jet recording head 48 (to form a dot corresponding to image information) to start image forming, according to the image information, on the recording sheet W on the B side. Due thereto, the recording head controller 84 controls the ink jet recording head 48 so as to start image formation, according to the image information, on the recording sheet W on the B side.

The processes of steps 100 and 114 to 122 will be described with reference to the timing chart of FIG. 6.

As illustrated in FIG. 6, if it is determined that the index pulse has been received in step 100, the pulses generated by the rotary encoder 52 (as the generating section that generates the pulse signal according to the rotation amount $\theta_0$ of the rotating drum 44) are measured (counted) till it reaches the pulse number of the third number Nb, in step 114. In steps 116 and 118, the time Pb shown by the width of the fourth predetermined number D (for instance, one) of pulses, before the timing when the pulse number of the third number Nb pulses is measured, is computed. The time Pb is divided by the first predetermined value K (for instance, 256) to compute the time T's (=Pb/K). In steps 120 and 122, after the timing when the pulse number of the third predetermined number Nb pulses is measured, when the time (ib×(Pb/K)), obtained by multiplying the time T's (Pb/K) by the second predetermined value ib corresponding to the B side, has elapsed, the recording head 48 as the image forming section is controlled to start image formation on the recording sheet W on the B side.

As described above, image forming on the recording sheet W on the A side starts when the timing of Ja (Ta+(ia×(Pa/K))) seconds has elapsed, from the rise (the reference timing) of the index pulse (reference pulse). Further, the image forming on the recording sheet W on the B side starts when the timing of Jb (Tb+(ib×(Pb/K))) seconds has elapsed, from the rise of the index pulse. Ta (sec) is the time required for counting Na pulses form the rise of the index pulse as a trigger. Tb (sec) is the time required for counting Nb pulses form the rise of the index pulse as a trigger.

The image forming apparatus 10 of the exemplary embodiment starts the measuring process for measuring the number of pulses of the pulse signal in step 102. Then, each time a predetermined number of pulses (Na pulses for the recording sheet W on the A side and Nb pulses for the recording sheet W on the B side) are measured for each of the plural recording sheets W (in the exemplary embodiment, the two recording sheets W on the A side and the B side) from the reference timing, the time (Pa for the recording sheet W on the A side and Pb for the recording sheet W on the B side) shown by a pulse width before the predetermined number of pulses measured by the measuring process is divided by the first predetermined value K (for instance, 256). The time ((Pa/K) for the recording sheet W on the A side and (Pb/K) for the recording sheet W on the B side) which is shorter than the time shown by the pulse width is computed in steps 108 and 118. Then, step 112 and the following processes are performed. Note that, the next process is performed each time the predetermined numbers of pulses are measured for each of the plural recording sheets W from the timing of generation of the index pulse. Namely, after the timing of measurement of the predetermined number of pulses, a time obtained by multiplying the computed time ((Pa/K) for the recording sheet W on the A side and (Pb/K) for the recording sheet W on the B side) which is shorter than the times Pa and Pb shown by the pulse width by the second predetermined value for each of the plural recording media W (ia for the recording sheet W on the A side and ib for the recording sheet W on the B side) corresponding to the recording sheet W to be image-formed, is calculated. The recording head 48 is controlled in step 122 so as to start image forming on the corresponding recording sheet W when the calculated time elapses.

The Na, Nb, ia, and ib are experimentally determined to appropriately form an image on both the recording sheets W on the A side and the B side.

Figure 7:
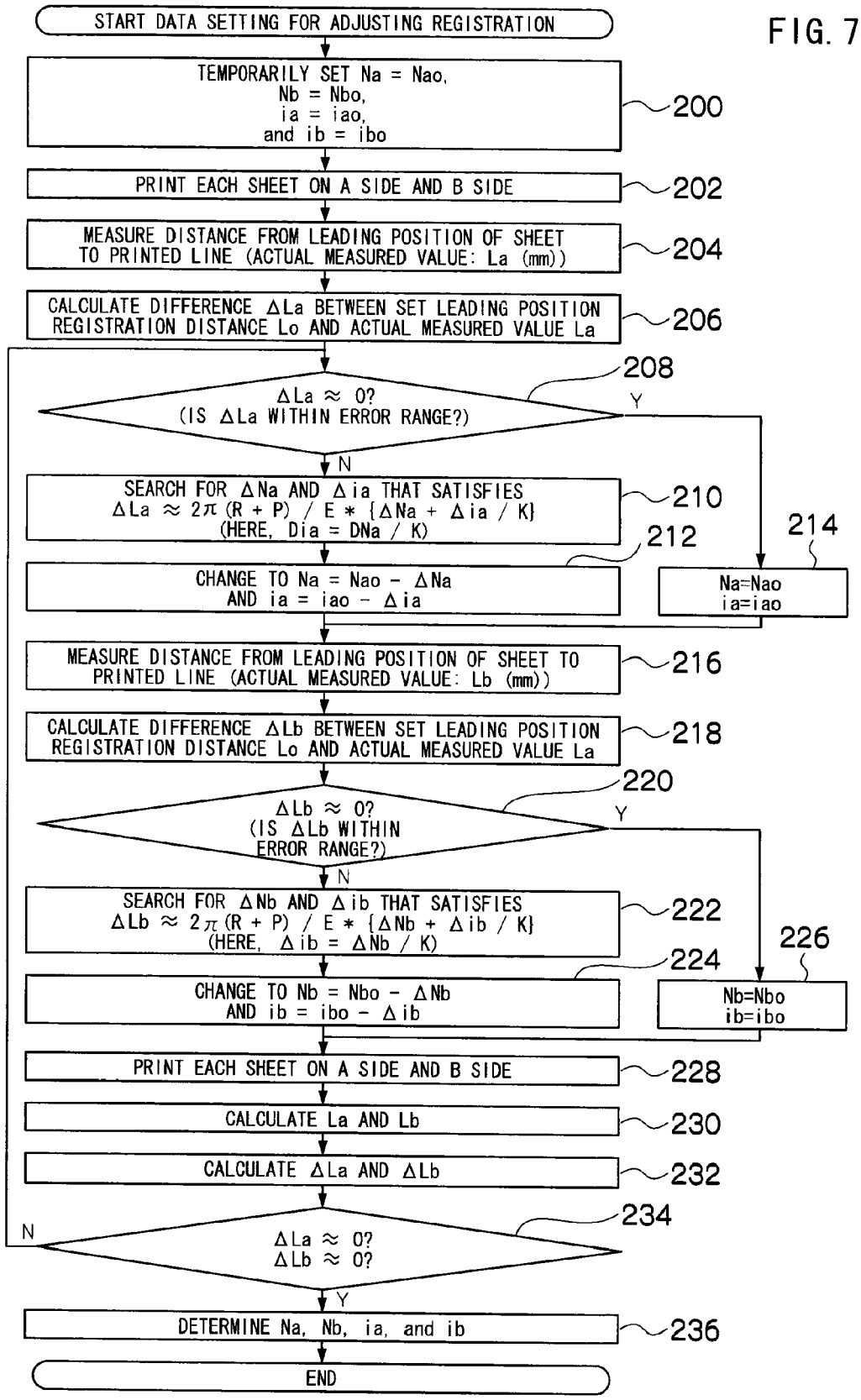
FIG. 7 is a diagram illustrating an example of a procedure for determining Na, Nb, ia, and ib.
Figure 8:
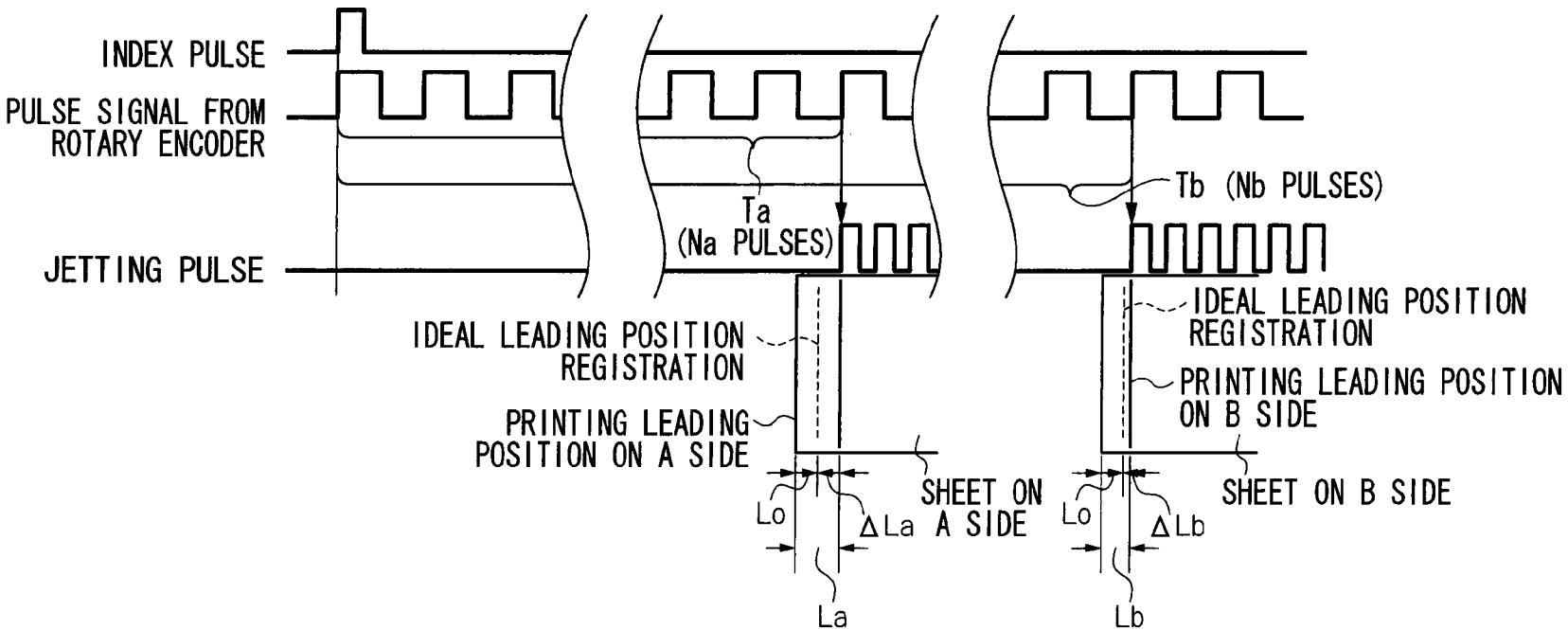
FIG. 8 is a diagram for explaining an example of the procedure for determining Na, Nb, ia, and ib.

An example of a procedure for determining the Na, Nb, ia, and ib will be described with reference to FIG. 7 and FIG. 8. In the following description: "Lo" denotes a distance (mm) from the leading position of the recording sheet to an ideal printing start position; "R" denotes a radius (mm) of the image forming drum; "P" denotes a sheet thickness (mm); "E" denotes the number of encoder pulses (ppr); and "K" denotes a division number. Note that, the above mentioned values are previously set.

In step 200, temporarily, an initial value Nao is set to the variable Na, an initial value Nbo is set to the variable Nb, an initial value iao is set to the variable ia, and an initial value ibo is set to the variable ib. Note that, these initial values may be any value. However, to simplify the process, it is preferred to set the initial value to a value that is close to an ideal value.

In step 202, a line, which is in parallel with the leading position of the recording sheet, is printed (image formed) to each of the sheets on the A side and the B side.

In step 204, a distance La (mm) from the leading position of the sheet on the A side to the printed line, is measured. Note that, the distance La may be directly measured or may be measured by image processing an image obtained by a photographing section such as a camera.

In step 206, difference between the distance Lo and the distance La is calculated as a difference ΔLa.

In step 208, whether ΔLa is within the error range, is determined. A certain value δ is previously determined. If, $-\delta \leqq \Delta La \leqq \delta$, it is determined that ΔLa is within the error range. If a negative determination is output, it is determined that ΔLa is not within the error range.

If it is determined in step 208 that ΔLa is within the error range, the routine proceeds to step 214. In step 214, again, the initial value Nao is set to the variable Na and the initial value iao is set to the variable ia. Note that, the step 214 may be omitted.

If it is determined in step 208 that ΔLa is not within the error range, the routine proceeds to step 210. In step 210, ΔNa and Δia that satisfies $\Delta La \approx 2\pi(R+P)/E*\{\Delta Na+\Delta ia/K\}$ are searched. Note that, $\Delta ia=\Delta Na/K$.

In step 212, (Nao−ΔNa) is set to the variable Na and (iao−Δia) is set to the variable ia.

In step 216, a distance Lb (mm) from the leading position of the sheet on the B side to the printed line is measured. Note that, the distance Lb may be directly measured or may be measured by image processing an image obtained by a photographing section such as a camera.

In step 218, a difference between the distance Lo and the distance Lb is calculated as a difference ΔLb.

In step 220, whether ΔLb is within the error range, is determined. The certain value δ is previously determined. If, $-\delta \leqq \Delta Lb \leqq \delta$, it is determined that ΔLb is within the error range. If a negative determination is output, it is determined that ΔLb is not within the error range.

If it is determined in step 220 that ΔLb is within the error range, the routine proceeds to step 226. In step 226, again, the initial value Nbo is set to the variable Nb and the initial value ibo is set to the variable ib. Note that, step 226 may be omitted.

If it is determined in step 220 that ΔLb is not within the error range, the routine proceeds to step 222. In step 222, ΔNb and Δib that satisfies $\Delta Lb \approx 2\pi(R+P)/E*\{\Delta Nb+\Delta ib/K\}$ are searched. Note that, $\Delta ib=\Delta Nb/K$.

In step 224, (Nbo−ΔNb) is set to the variable Nb and (ibo−Δib) is set to the variable ib.

In step 228, a line, which is parallel with the leading position of the recording sheet, is printed (image formed) to each of the sheets on the A side and the B side.

In step 230, the distance La (mm) from the leading position of the sheet on the A side to the printed line is measured, and the distance Lb (mm) from the leading position of the sheet on the B side to the printed line is measured.

In step 232, the difference between the distance Lo and the distance La measured in step 230 is calculated as the difference ΔLa. Together therewith, in step 232, the difference between the distance Lo and the distance Lb measured in step 230 is calculated as the difference ΔLb.

In step 234, whether the difference ΔLa calculated in step 232 is 0 or a value close to 0 ($-\delta \leqq \Delta La \leqq \delta$), and whether the difference ΔLb calculated in step 232 is 0 or a value close to 0 ($-\delta \leqq \Delta Lb \leqq \delta$), is determined. If a negative determination is output in step 234, the routine returns to step 208. If an affirmative determination is output in step 234, the values of the variables Na, Nb, ia, and ib are set as the first number Na, the third number Nb, the second value ia that corresponds to the recording sheet W on the A side, and the second value ib that corresponds to the recording sheet W on the B side, respectively. Due thereto, the first number Na, the third number Nb, the second value ia, and the second value ib are determined. Accordingly, this routine finishes.

In the exemplary embodiment, the image forming apparatus that directly forms an image on the recording sheet W by the ink jet recording head has been described. However, the invention is not limited to this. The image forming apparatus may be one that forms an image on the recording sheet W via an intermediate transfer member as the rotating body. As an example of such an image forming apparatus, a recording head, as an image forming portion, having a light emitting element (a light emitting section), such as an LED which emits a light beam, may form a latent image on the peripheral surface (a predetermined side) of a photosensitive drum which is a rotating body, the latent image may be made into a toner image using a material (for instance, toner) for forming an image, and the toner image may be transferred onto the surface of the recording sheet. In this form, the latent image according to image information is formed on the circumferential surface by the light beam, emitted from the light emitting section, according to the image information. The material for forming an image is attached to the formed latent image. Then, the image formed on the circumferential surface is transferred onto the recording sheet via the rotating photosensitive drum. The invention may be applied to the image forming apparatus having the rotating photosensitive drum.

Namely, the photosensitive drum is the rotating body that functions as the transfer member that transfers each of plural images formed on the circumferential surface onto each of plural recording sheets.

The configuration of the image forming apparatus 10 described in the exemplary embodiment is an example and may be modified according to the conditions within the range without departing from the purpose of the invention.

The equations described in the exemplary embodiment are an example. Therefore, unnecessary parameters may be deleted, and new parameters may be added.

The flow of the process of various processing programs described in the exemplary embodiments is an example. Within the range without departing the purpose of the invention, an unnecessary step may be deleted, a new step may be added, and the process of orders may be replaced.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a rotating body that rotates and holds a plurality of recording media on a circumferential surface of the rotating body;

an image forming section that forms an image on the recording media held on the rotating body when rotating;

a generating section that generates a pulse signal according to the rotation amount of the rotating body and generates a reference pulse for every rotation cycle of the rotating body;

a measuring section that measures the number of pulses of the pulse signal;

a computing section that each time when a predetermined number of pulses from the time of generation of the reference pulse has been measured, divides a time of a pulse width of a pulse before the predetermined number of pulses by a first value to compute a pulse division time, the predetermined number of pulses being predetermined for each of the plurality of recording media; and a controlling section that each time when the predetermined number of pulses are measured from the time of generation of the reference pulse, multiplies the pulse division time by a second predetermined value, thereby obtaining a forming start time, and that controls the image forming section so as to start image formation when the forming start time has elapsed from the time of measurement of the predetermined number of pulses, the second predetermined value being predetermined for each of the plurality of recording media.

2. The image forming apparatus of claim 1, wherein the image forming section comprises a recording head including a plurality of image forming elements forming a dot configuring an image, and wherein the rotating body is an image forming drum that rotates while holding the recording media on a circumferential surface thereof, such that the image can be formed.

3. An image forming apparatus comprising:

a rotating body that rotates and transfers a plurality of images formed on the circumferential surface of the rotating body onto a plurality of recording media;

an image forming section that forms an image on the circumferential surface of the rotating body when rotating;

a generating section that generates a pulse signal according to the rotation amount of the rotating body and generates a reference pulse for every rotation cycle of the rotating body;

a measuring section that measures the number of pulses of the pulse signal;

a computing section that each time when a predetermined number of pulses from the time of generation of the reference pulse has been measured, divides a time of a pulse width of a pulse before the predetermined number of pulses by a first value to compute a pulse division time, the predetermined number of pulses being predetermined for each of the plurality of recording media; and a controlling section that each time when the predetermined number of pulses are measured from the time of generation of the reference pulse, multiplies the pulse division time by a second predetermined value, thereby obtaining a forming start time, and that controls the image forming section so as to start image formation when the forming start time has elapsed from the time of measurement of the predetermined number of pulses, the second predetermined value being predetermined for each of the plurality of recording media.

4. The image forming apparatus of claim 2, wherein the image forming section is a light emitting section that emits a light beam according to image information, and the rotating body is an exposing drum that rotates to form a latent image on the circumferential surface of the rotating body according to the image information, forms an image on the circumferential surface of the rotating body by attaching a material to the latent image, and transfers the formed image onto the recording media.

5. A non-transitory computer-readable medium storing a program causing a computer to execute a process for controlling an image forming apparatus including, a rotating body that rotates and holds a plurality of recording media on the circumferential surface of the rotating body, a generating section that generates a pulse signal according to the rotation amount of the rotating body and generates a reference pulse for every rotation cycle of the rotating body, a measuring section that measures the number of pulses of the pulse signal, an image forming section that forms an image on the recording media held on the circumferential surface of the rotating body when rotating, and a controlling section that controls the image forming section, the process comprising:

computing a pulse division time by dividing a time of a pulse width of a pulse before the predetermined number of pulses by a first value, each time when a predetermined number of pulses from the time of generation of the reference pulse has been measured, the predetermined number of pulses being predetermined for each of the plurality of recording media;

calculating a forming start time by multiplying the pulse width division time by a second predetermined value each time when the predetermined number of pulses is measured from the time of generation of the reference pulse, the second predetermined value being predetermined for each of the plurality of recording media; and controlling to start image formation when the forming start time has elapsed from the time of measurement of the predetermined number of pulses.

6. A non-transitory computer-readable medium storing a program causing a computer to execute a process for controlling an image forming apparatus including, a rotating body that rotates and transfers each of a plurality of images formed on the circumferential surface of the rotating body onto each of a plurality of recording media, a generating section that generates a pulse signal according to the rotation amount of the rotating body and generates a reference pulse for every rotation cycle of the rotating body, a measuring section that measures the number of pulses of the pulse signal, an image forming section that forms an image on the circumferential surface of the rotating body when rotating, and a controlling section that controls the image forming section, the process comprising:

computing a pulse division time by dividing a time of a pulse width of a pulse before the predetermined number of pulses by a first value, each time when a predetermined number of pulses from the time of generation of the reference pulse has been measured, the predetermined number of pulses being predetermined for each of the plurality of recording media;

calculating a forming start time by multiplying the pulse width division time by a second predetermined value each time when the predetermined number of pulses is measured from the time of generation of the reference pulse, the second predetermined value being predetermined for each of the plurality of recording media; and controlling to start image formation when the forming start time has elapsed from the time of measurement of the predetermined number of pulses.

7. A method for controlling an image forming apparatus including, a rotating body that rotates and holds a plurality of recording media on the circumferential surface of the rotating body, a generating section that generates a pulse signal according to the rotation amount of the rotating body and generates a reference pulse for every rotation cycle of the rotating body, a measuring section that measures the number of pulses of the pulse signal, an image forming section that forms an image on the recording media held on the circumferential surface of the rotating body when rotating, and a controlling section that controls the image forming section, the process comprising:

computing a pulse division time by dividing a time of a pulse width of a pulse before the predetermined number of pulses by a first value, each time when a predetermined number of pulses from the time of generation of the reference pulse has been measured, the predetermined number of pulses being predetermined for each of the plurality of recording media;

calculating a forming start time by multiplying the pulse width division time by a second predetermined value each time when the predetermined number of pulses is measured from the time of generation of the reference pulse, the second predetermined value being predetermined for each of the plurality of recording media; and controlling to start image formation when the forming start time has elapsed from the time of measurement of the predetermined number of pulses.

8. A method for controlling an image forming apparatus including, a rotating body that rotates and transfers each of a plurality of images formed on the circumferential surface of the rotating body onto each of a plurality of recording media, a generating section that generates a pulse signal according to the rotation amount of the rotating body and generates a reference pulse for every rotation cycle of the rotating body, a measuring section that measures the number of pulses of the pulse signal, an image forming section that forms an image on the circumferential surface of the rotating body when rotating, and a controlling section that controls the image forming section, the process comprising:

computing a pulse division time by dividing a time of a pulse width of a pulse before the predetermined number of pulses by a first value, each time when a predetermined number of pulses from the time of generation of the reference pulse has been measured, the predetermined number of pulses being predetermined for each of the plurality of recording media;

calculating a forming start time by multiplying the pulse width division time by a second predetermined value each time when the predetermined number of pulses is measured from the time of generation of the reference pulse, the second predetermined value being predetermined for each of the plurality of recording media; and controlling to start image formation when the forming start time has elapsed from the time of measurement of the predetermined number of pulses.

* * * * *